United States Patent [19]

Bauer

[11] 4,163,642

[45] Aug. 7, 1979

[54] PROCESS FOR THE SUBLIMATION TRANSFER DYEING OF TEXTILE MATERIALS INCLUDING SUBSEQUENT CONDUCTIVE HEADING

[75] Inventor: Jackson Bauer, Croydon, Pa.

[73] Assignee: Collins & Aikman Corporation, New York, N.Y.

[21] Appl. No.: 813,520

[22] Filed: Jul. 7, 1977

[51] Int. Cl.[2] ..... D06P 1/16; D06P 5/02; D06P 3/54

[52] U.S. Cl. ..... 8/2.5 A; 8/2.5 R; 8/176

[58] Field of Search ..... 8/2.5 A, 2.5 R, 176

[56] References Cited

U.S. PATENT DOCUMENTS

| | | | |
|---|---|---|---|
| 3,464,779 | 9/1969 | Collez | 8/2.5 A |
| 3,666,397 | 5/1972 | Datye et al. | 8/2.5 A |
| 3,707,346 | 12/1972 | Markert et al. | 8/2.5 A |
| 3,880,579 | 4/1975 | Renaut | 8/176 |
| 4,013,407 | 3/1977 | Ray | 8/2.5 A |
| 4,027,345 | 6/1977 | Fujisawa et al. | 8/2.5 A |

FOREIGN PATENT DOCUMENTS

| | | | |
|---|---|---|---|
| 2312418 | 9/1973 | Fed. Rep. of Germany | 8/2.5 A |

*Primary Examiner*—Melvyn I. Marquis
*Assistant Examiner*—Maria S. Tungol
*Attorney, Agent, or Firm*—Paul & Paul

[57] ABSTRACT

An improved process is provided for the transfer printing of textile materials. In the process of this invention a heat sublimable dyestuff is printed onto a carrier sheet. The carrier sheet is then brought in contact with the textile material to be printed. Sufficient heat and pressure is applied for a suitable dwell time causing sublimation of at least a substantial portion of the dyestuff from the carrier sheet. The volatilized dyestuff is then transferred and deposited on the surface of the textile material to be printed. The carrier sheet is then separated from the textile material. The printed surface of the textile material is then heated to at least the sublimation temperature of the dyestuff in substantial absence of a convective gas flow, other than the volatilized dyestuff and maintained at this temperature until a given desired degree of resublimation and deposition of the dyestuff from the surface of the textile material to the interior of the textile material is obtained.

9 Claims, No Drawings

PROCESS FOR THE SUBLIMATION TRANSFER DYEING OF TEXTILE MATERIALS INCLUDING SUBSEQUENT CONDUCTIVE HEADING

This invention relates to an improved process for the sublimation transfer dyeing of textile material and is more particularly concerned with a process for transferring printing fabric with improved definition and uniformity of color and improved fastness to crocking, resublimation and was fastness.

It is well known in the art to print textile materials by the process known as transfer printing. In this process the dyestuff and usually a binder are printed in a given design by conventional means on a paper or foil carrier sheet.

The design may be printed on the carrier sheet, normally paper, by any of the usual paper printing processes such as a flexographic, lithographic, gravure, letter press or screen printing process. The printing ink is formulated to be suitable for the desired process, and in general is made up of one or more solvents, a resinous or oily binder, thickening materials, and the desired sublimable dyestuffs, either in finely divided form or wholly or in part in solution. The binder material should not decompose or transfer at or below the required transfer temperature of the dyestuffs.

The dyestuffs which are selected for use in transfer printing can be characterized as being sublimable under conditions of heat and pressure which are below the fusion point of the textile material to be printed. As examples of dyestuffs which can be used in transfer printing, there may be mentioned disperse dyestuffs such as those described in the second edition of the Colour Index (1956) pages 1665–1742. Disperse dyestuffs are generally classified as low energy dyes, medium energy dyes and high energy dyes depending upon the minimum amount of energy required to sublime the dyestuff. The dyestuffs which may be used in accordance with this invention are not limited to dispersed dyes. Other classes of dyes which sublime at reasonable low temperatures are suitable such as certain vat dyestuff such as those disclosed at pages 2419–2564 of the second edition of the Colour Index.

The textile materials which may be transfer printed in accordance with this invention may be selected from a broad range of fiber types and forms. As examples of synthetic textile materials which can be colored by the transfer process of the invention, there may be mentioned cellulose acetate and cellulose triacetate textile materials, polyamide textile materials, such as polycaprolactam and polyhexamethyleneadipamide textile materials, polyalkylene textile materials such as polypropylene textile materials, and preferably aromatic polyester materials such as polyethylene terephthalate textile materials. Such textile materials can be in the form of thread, yarn, webs, or woven or knitted fabrics. If desired the synthetic textile materials can be in the form of blend with other textile materials, for example polyester/cotton and polyester/wool blends. For reasons which will become more apparent hereinafter the process of this invention is especially suitable for the transfer printing of fabrics with intricated multicolor designs in heavy dark colors.

In the transfer printing of relatively light or pastel patterns it has been found as expected that relatively substantially lesser amounts of the heat sublimable dyestuff is required to be printed on the transfer sheet to obtain the desired depth of color. More significantly it has been found that there is usually more nearly substantially complete transfer of the dyestuff from the carrier sheet to the textile material. However, when darker colors are desired, greater amounts of dyestuff must be printed on the carrier sheet to obtain the desired color. It has been found that the general greater amounts of dyestuff employed results in substantial amounts, often up to 40% and even more of the dyestuff remaining on the carrier sheet. A more troublesome problem which is encountered, however, is that dyestuff which is deposited on the textile material tends to be more likely to resublime and have limited crock resistance. A further problem is that the resulting pring especially with texturized fabric tends to be non-uniform in depth of shade. The depth of penetration of the dyes into the thickness of the fabric is minimal so that "frosting" can occur when the fabric surface is subsequently abraded.

The exact cause of the above condition is not precisely known. It is believed, however, to be a result of the physical-chemical nature of the transfer printing process. In the transfer printing method, as conventionally employed, after the carrier sheet is brought into contact with the textile material to be printed, heat is applied to the back of the carrier sheet, that is the unprinted surface of the carrier sheet. The heat raises the temperature of the dyestuffs on the surface to or above their sublimation temperature. Because the heat applied to the carrier sheet is the driving force, the dye vapors travel away from the heat source and deposit on the textile material. If the heating is continued eventually an equilibrium is reached with regard to the vapor pressure of the dye vapor over the dyestuff on the textile material and the vapor pressure of the dye vapor over the dyestuff on the carrier sheet. If the heating from the carrier sheet is continued it can cause a supersaturation of the dye vapor with a resulting depostion of excess dye on the surface textile material. This excess dye is not absorbed by the fibers of textile material but rather deposited on the exposed surface. This deposited dye is believed to be the cause of resublimation and poor crock-fastness problems.

Attempts have been made to improve the results obtained when transfer printing heavy concentration of dyestuffs especially on thick fabrics, such as upholstery fabrics, where dye penetration into the fabric thickness is necessary. Attempts were made to reheat the combination of the carrier sheet and the printed textile material. This at best caused even poorer results, with dye tending to spread laterally on the fabric rather than into the fabric thickness, which causes loss of definitive of the printed pattern.

It was further suggested to use a vacuum to draw the volatile dyestuffs through the fabric during the transfer printing step. While this process was reported to improve the dyeing process, apparently because of the dynamic force of vacuum applied, the vacuum had the tendency to cause excess diffusion of the vaporized dyestuff from the area desired to be printed resulting in distortion of the intended design.

Attempts were further made to pass hot gases, such as hot air, steam and the like through the fabric as an after treatment once the carrier sheet was separated from the fabric. The results achieved under these conditions were quite unsatisfactory. The hot gases caused resublimation of the dyestuff and the vaporized dyestuff, because of the dynamic effect of the flow of hot gases, migrated throughout the fabric in all directions and caused distortion of the desired design without accomplishing the desired penetration in the fabric thickness.

It has been found and it is the basic of this invention that clear sharp prints with excellent penetration through the material can readily and simply be achieved with improved crock resistance and reduced resublimation potential and with reduced tendency for the printed fabric to transfer color to other materials with which they may come into contact. In accordance with this invention the textile material is transfer printed in the conventional manner with the carrier sheet being brought into contact with the textile material to be printed and sufficient heat and pressure being applied to cause dyes applied to the carrier sheet to volatilize and redeposite on the textile material. To achieve the optimum result a predetermined excess of dyestuff required to achieve the final desired depth of color is initially deposited on the surface of the textile.

The carrier sheet is then separated from the printed textile material. The printed surface of the textile material is then brought into direct contact with a heat source in the substantial absence of any dynamic gases such as hot air under pressure, steam or the like. Heat and preferably pressure is applied in an amount sufficient to cause a resublimation of the excess dyestuff on the surface of the textile material without any damage to the textile material. Under the conditions of this invention this dye has been found to move substantially perpendicularly away from the plane of the heated surface and not to sublime laterally as might have been expected.

The dwell time of exposure to the heat source is maintained for a sufficient length of time at the given temperature and pressure to obtain the desired sublimation of dyestuff from the surface and redeposition of the dyestuff within the textile material. The effect of the second heat treatment can be determined by a visual comparison of the front and back of the fabric before and after the second heat treatment to determine the degree of change of color and depth of penetration. It should be noted it is possible using the process of the invention to transfer more dyestuff than desired from the printed surface to the interior of the fabric so as to reduce the color depth visible on the fabric surface to less than that desired by exposing the fabric to sublimation condition for an excessive length of time. The ultimate test is the determination of the degree of resistance of the printed textile material to resublimation and crocking and other forms of dye transfer coupled with an acceptable print appearance.

The heat source which is used for the treatment of the textile material after the carrier sheet has been removed can be selected from a source which transfers the heat to the printed surface by either conduction or radiation. Heat sources which convey the heat by convection such as forced gases, such as hot air or steam, should be avoided to prevent lateral movement of the volatile dyestuff with a resulting distortion of the desired design.

One source of radiation heat is infrared lamps placed adjacent to the printed surface. This type of heating is advantageous in that there can be minimum or no contact with apparatus which can cause undesired transfer of dyestuff to the equipment. When a radiation heat source is used such as a bank of infrared lamps and the textile material is moved past the lamps any inherent convection caused by the movement of the textile material past the infrared heat lamps should be limited as much as possible. This can be accomplished by moving the fabric in sequence with the lamps mounted on a rotating drum around which the fabric is advanced. It is highly desirable to focus the lamp so that the radiation contacts the printed surface substantially perpendicular to the printed surface of the fabric.

The heat source when of the conductive type can be of various configurations such as heated drums, plates or the like brought into direct contact with the previously printed side of the fabric. The use of a heated drum is the preferred method in that it is possible to synchronize the speed of feed of the textile material and the surface speed of the drum to be the same so that there is relative lack of movement between the drum and the printed surface of the textile material. This brings about the optimum results under normal commercial plant conditions. The heat for directional resublimation is transferred by conduction rather than convection from the heated surface to the printed surface of the textile material. The pressure can be applied with a blanket or the like holding the fabric tightly in contact with the heated surface. Under these conditions after resublimation the volatile gases of dyestuff move substantially vertical and directly away from the heated surface. Under these conditions of after treatment, the printed surface of the textile material acts as the "quasi-carrier" sheet with the interior portion of the textile material absorbing the sublimed dyestuff in amounts sufficient to prevent resublimation and crocking in the finished material. A further advantage of this process is that sharp prints with clear demarcation between different colors and areas are obtained as opposed to methods where convection heat sources, such as high pressure steam, are used wherein the dyestuff defusses laterally. A further advantage of the process is that the dye on the fibers will penetrate through the fiber to the extent that "ring dyeing" is minimized and more uniform penetration throughout the fiber cross section is achieved. This results in improved resistance to "frosting," a common problem in transfer printed fabrics.

The selection of the dyestuffs used, as well as the particular temperatures, pressures and dwell times for a given fabric are readily obtained by simple test runs well within the skill of the art of persons familiar with conventional transfer printing of textile material. These conditions can be varied to obtain the desired degree of resublimation and penetration in the process of this invention.

Suitable conditions for polyester fabrics were found to be a temperature of 380° -450° F., and preferably 410° -440° F. at a pressure from about 0.5 to 2.0 p.s.i.g. for a dwelling time of 15-19 seconds and preferably 30-60 seconds.

Experiments were run with various heat sublimable dispersed dyestuffs. The dyestuff was printed on a paper transfer sheet. A white polyester warp knit fabric was printed in the conventional manner at a temperature of 410° F. and a dwelling time of 30 seconds with pressure being blanket applying a pressure of about 1 p.s.i.g. The carrier sheet was removed from the fabric. The fabric was then reheated by conduction under pressure for various times and temperatures with the following results being obtained:

TABLE I

Improvement In Colorfastness And Color Development Resulting From Additional Heat Treatment Polyester Fabric

| Dye Tested | Heat Treatment | Dye Development Face of Fabric* | Dye Penetration Back of Fabric* | Crocking** Wet | Crocking** Dry | Wet Resublimation** | Dry Resublimation** |
|---|---|---|---|---|---|---|---|
| Disperse Red 65 | Original | 1 | 1 | 3-2 | 1 | 1 | 1 |
| | Reheated 420° F. 30 Sec. | 4-5 | 3 | 4-5 | 3 | 2-1 | 2-1 |
| | Reheated 420° F. 60 Sec. | 3 | 4 | 5-4 | 4-3 | 2 | 3-2 |
| | Reheated 440° F. 30 Sec. | 3-4 | 3-4 | 5-4 | 4-3 | 2 | 3 |
| Disperse Blue 60 | Original | 1 | 1 | 5-4 | 4 | 3 | 3 |
| | Reheated 420° F. 30 Sec. | 4-5 | 3 | 5 | 4-5 | 4-3 | 4-3 |
| | Reheated 420° F. 60 Sec. | 4 | 3 | 5-4 | 4-5 | 4 | 4 |
| | Reheated 440° F. 30 Sec. | 4-5 | 3-4 | 5 | 4-5 | 4 | 4 |
| Disperse Yellow 116 | Original | 1 | 1 | 4 | 3 | 2 | 2 |
| | Reheated 420° F. 30 Sec. | 1-2 | 2 | 5-4 | 4 | 3 | 4-3 |
| | Reheated 420° F. 60 Sec. | 2 | 3 | 5-4 | 4 | 3 | 4-3 |
| | Reheated 440° F. 30 Sec. | 1-2 | 2 | 5 | 4 | 3 | 4-3 |
| Disperse Violet 38 | Original | 3 | 1 | 5-4 | 3 | 1 | 1 |
| | Reheated 420° F. 30 Sec. | 2 | 3 | 5-4 | 4 | 1-2 | 1 |
| | Reheated 420° F. 60 Sec. | 1 | 4 | 5-4 | 4 | 2 | 2 |
| | Reheated 440° F. 30 Sec. | 3 | 4 | 4 | 4-3 | 1-2 | 2-1 |
| Disperse Yellow 3 | Original | 1 | 1 | — | | — | |
| | Reheated 420° F. 30 Sec. | 1 | 2 | — | | — | |
| | Reheated 420° F. 60 Sec. | 1 | 4 | — | | — | |
| | Reheated 440° F. 30 Sec. | 1 | 3 | — | | — | |
| Intratherm Yellow 348 | Original | 1 | 1 | 5-4 | 4-3 | 3 | 4-3 |
| | Reheated 420° F. 30 Sec. | 1 | 2 | 5-4 | 4 | 4-3 | 4 |
| Intratherm Yellow 348 | Reheated 420° F. 60. Sec. | 1 | 3 | 5 | 4 | 4-3 | 4 |
| | Reheated 440° F. 30 Sec. | 1 | 2 | 5 | 4 | 4-3 | 4 |

*1 = Original or Minimum Depth
2 = Slight Increase
3 = Fair Increase
4 = Good Increase
5 = Strong Increase
**1 = Very Poor; Unacceptable
2 = Poor; Unacceptable
3 = Fair; Borderline
4 = Good; Acceptable
5 = Excellent; Acceptable

What is claimed is:

1. An improved for *sublimation* transfer printing a textile material having a face surface, a back surface and a given thickness, said process comprising the steps of:

(a) contacting the face surface of the textile material with a carrier sheet having printed on a first surface thereof a heat sublimable dyestuff, with said first surface being in contact with the face surface of the textile material, (b) heating the carrier sheet to a temperature sufficient to cause at least a portion of said dyestuff to sublime to a volatilized state, (c) transferring at least a portion of dyestuff in the volatilized state to the face surface and partially through the thickness of the textile material adjacent to the face surface, (d) condensing the dyestuff on the face surface and partially through the thickness of the textile material adjacent to the face surface, (e) removing the carrier sheet from the face of the textile material, (f) conductively heating the resulting printed face surface of the textile material by contact with a heated member to a temperature at least sufficient to revolatilize the dyestuff in the absence of dynamic directional gaseous convective fluids and liquids other than those generated by the conductive heating of said textile material, (g) transferring a portion of the dyestuff in the volatilized state from the face of the textile material in a direction substantially perpendicular to the face of the textile material towards the back surface, and (h) condensing the resublimed dyestuff in the interior of the textile material, whereby a transfer printed textile material is obtained having improved dyestuff distribution with resulting improved resistance to resublimation, crocking and having improved wash fastness.

2. The process according to claim 1 wherein the heated member is a heated revolving drum.

3. The process according to claim 1 wherein said surface speed of said drum is synchronized with the speed of advancement of the fabric.

4. The process according to claim 1 wherein the heat source is a heated planar surface.

5. The process according to claim 1 wherein said textile material is a textile fabric.

6. The process according to claim 1 wherein the textile material is a polyester.

7. The process according to claim 6 wherein the dyestuff is a dispersed dyestuff.

8. The process according to claim 7 wherein the said carrier sheet and the resulting printed face surface of the textile material are heated to a temperature of 380°–450° F. at a pressure of 0.5–2.0 p.s.i.g. for a period of 15–19 seconds.

9. The process according to claim 7 wherein the said carrier sheet and said resulting printed face surface are heated to a temperature of 410°–440° F. at a pressure of 0.5–2.0 p.s.i.g. for a period of 30–60 seconds.

* * * * *

UNITED STATES PATENT OFFICE

CERTIFICATE OF CORRECTION

Patent No. 4,163,642 Dated August 7, 1979

Inventor(s) Jackson Bauer

It is certified that error appears in the above-identified patent and that said Letters Patent are hereby corrected as shown below:

Column 1, line 11, change "was" to --wash--.
Column 2, line 14, change "pring" to --print--.
Column 2, line 38, change "depostion" to --deposition--.
Column 7, line 1, after "improved" insert -process--.

Column 1, line 63, change "intricated" to --intricate--.
Column 2, line 52, change "definitive" to --definition--.
Column 3, line 4, change "basic" to --basis--.
Column 3, line 16, change "redeposite" to -redeposit--.
Column 4, line 38, change "defusses" to --defuses--.

Signed and Sealed this

*Nineteenth* Day of *August 1980*

[SEAL]

*Attest:*

SIDNEY A. DIAMOND

*Attesting Officer*

*Commissioner of Patents and Trademarks*